US010260205B2

(12) United States Patent
Laugwitz et al.

(10) Patent No.: US 10,260,205 B2
(45) Date of Patent: Apr. 16, 2019

(54) ROAD PAVER WITH CONTROL UNIT FOR DETERMINING THE WEIGHT AND/OR THE CENTER OF GRAVITY AND/OR THE WIDTH OF THE SCREED AND CORRESPONDING METHOD

(71) Applicant: BOMAG GmbH, Boppard (DE)

(72) Inventors: Niels Laugwitz, Lahnstein (DE); Michael Witsch, Simmern (DE); Moritz Nick, Boppard (DE)

(73) Assignee: BOMAG GmbH, Boppard (DE)

( * ) Notice: Subject to any disclaimer, the term of this patent is extended or adjusted under 35 U.S.C. 154(b) by 0 days.

(21) Appl. No.: 15/458,438

(22) Filed: Mar. 14, 2017

(65) Prior Publication Data

US 2017/0268181 A1 Sep. 21, 2017

(30) Foreign Application Priority Data

Mar. 18, 2016 (DE) ..... 10 2016 003 385

(51) Int. Cl.
*E01C 19/42* (2006.01)
*E01C 19/48* (2006.01)
(Continued)

(52) U.S. Cl.
CPC ..... *E01C 19/486* (2013.01); *E01C 19/30* (2013.01); *E01C 19/42* (2013.01); *E01C 19/48* (2013.01);
(Continued)

(58) Field of Classification Search
CPC ..... E01C 19/30; E01C 19/48; E01C 19/486; E01C 23/01; E01C 19/42; E01C 19/4853;
(Continued)

(56) References Cited

U.S. PATENT DOCUMENTS 5,356,238 A * 10/1994 Musil ..... E01C 19/008 404/101
7,669,458 B2 * 3/2010 Commuri ..... E01C 19/288 73/32 A
(Continued)

FOREIGN PATENT DOCUMENTS

DE 102004003356 A1 8/2005
EP 2233641 A2 9/2010

*Primary Examiner* — Raymond W Addie
(74) *Attorney, Agent, or Firm* — Wood Herron & Evans LLP

(57) ABSTRACT

A road paver is provided with a drive, a bunker, a material conveying device, a screed comprising a tamping device and an electric heating device on the screed and/or on the tamping device, wherein a control unit is configured in such a manner that it determines, by means of a measurable electrical operating parameter of the electrical heating device on the screed and/or on the tamping device, the weight and/or the center of gravity and/or the width of the screed transversely to the working direction of the screed. A method for determining a width and/or a weight and/or a center of gravity of a screed of a road paver, comprising the steps: measuring an electrical variable of a heating device, in particular a heating power, a heating resistance or a power consumption of the heating device; calculating the weight and/or the center of gravity and/or the width of the screed transversely to the working direction of the screed by means of the electrical operating variable.

19 Claims, 4 Drawing Sheets

(51) Int. Cl.
*E01C 19/30* (2006.01)
*E01C 23/01* (2006.01)

(52) U.S. Cl.
CPC ..... *E01C 19/4853* (2013.01); *E01C 19/4873* (2013.01); *E01C 23/01* (2013.01); *E01C 2301/10* (2013.01); *E01C 2301/14* (2013.01)

(58) Field of Classification Search
CPC ..... E01C 19/4873; E01C 2301/10; E01C 2301/14
USPC ..... 404/84.05, 118
See application file for complete search history.

(56) References Cited

U.S. PATENT DOCUMENTS 8,930,092 B2 * 1/2015 Minich ..... E01C 23/07 701/50
9,367,042 B2 * 6/2016 Oetken ..... E01C 19/288

* cited by examiner

ROAD PAVER WITH CONTROL UNIT FOR DETERMINING THE WEIGHT AND/OR THE CENTER OF GRAVITY AND/OR THE WIDTH OF THE SCREED AND CORRESPONDING METHOD

CROSS-REFERENCE TO RELATED APPLICATIONS

The present application claims priority under 35 U.S.C. § 119 of German Patent Application No. 10 2016 003 385.1, filed Mar. 18, 2016, the disclosure of which is hereby incorporated herein by reference in its entirety.

FIELD OF THE INVENTION

The present invention relates to a road paver with a drive, a bunker, a material conveying device, a screed, comprising, in particular, also a tamping device, and an electric heating device on the screed and/or if present, on the tamping device. The present invention further relates to a method for determining a width and/or a weight and/or a center of gravity position of a screed of a road paver.

BACKGROUND OF THE INVENTION

With conventional road pavers, especially with asphalt road pavers, it is well known that the paving screed (abbreviated in the following to "screed") must be guided in a floating manner over the material to be paved during the working process. Such screeds may be designed as rigid screeds or as screeds with sliding parts. Adapting the paving screed to the desired working width is effected by the optional mounting of suitable add-on screed elements and/or by retracting and extending movable screed segments with respect to a basic screed. The width of the screed has a decisive effect on the work processes of the road pavers, for example, on how quickly the paver can travel during the laying of a support layer of a road, how much electricity has to be produced by a generator for supplying electric loads on the screed and how much paving material has to be transported from the material bunkers of the road finisher to the screed. Since the width of the screed is variable, the current width of the screed must be entered by the operator at the road paver to control the workflow. The paving screed can be held in a desired position during the paving process by means of generally two hydraulic actuating cylinders, which are, for example, connected on the piston side or on the housing side with the chassis of the road paver and on the piston rod side with the paving screed or vice versa. For example, when the paver is stopped, the pressure on the screed is usually relieved by means of the hydraulic actuating cylinders in order to prevent the screed from sinking into the mixed material. It may also be necessary to lessen the load on the screed when the road paver ascends a hill, e.g., in order to increase the traction of the road paver. Such a road paver is known, for example, from EP 2 233 641 A2, to which reference is made herewith.

However, the problem here is that the operator of the road paver must enter the width of the screed manually in order to control the workflows at the road paver. In this case, it may occur that the precise width of the screed is not known exactly to the operator, particularly when width-adjustable screed segments are used. Thus, deviations of the set screed width from the actual screed width can occur. The consequence is longer warming-up times for screed heating systems, a failure to reach target temperatures, an increased strain on generators and electrical components of the heating system (for example, safeguards) and increased fuel consumption. In addition, the center of gravity of the screed is usually not known precisely and changes with altered paving widths. This makes it difficult to control or regulate the necessary load pressure or relief pressure to be applied to the screed by the hydraulic actuating cylinders accurately. However, in order to ensure a correct working of the road paver, a correct load or relief pressure on the screed is necessary, as otherwise the screed is subjected to asymmetric pressures, which adversely affects the compaction of the mixed material. The set pressure must therefore frequently be changed manually in order take the total weight of the screed into account adequately during the adjustment of the hydraulic cylinders.

SUMMARY OF THE INVENTION

It is thus an object of the present invention to eliminate the described problems. Specifically, the control of the road paver is to be simplified depending on the operating situation of the screed, in particular the weight and/or the center of gravity and/or the width of the screed.

According to one embodiment of the present invention, a road paver is provided, comprising a drive, a bunker, a material conveying device, a screed optionally including a tamping device and an electric heating device on the screed and/or, if present, on the tamping device, wherein a control unit is present, which is configured in such a manner that, by means of a measurable electrical operating parameter of the electrical heating device on the screed and/or, if present, on the tamping device, the weight and/or the center of gravity and/or the width of the screed transversely to the working direction of the screed is/are determined. The present invention thus likewise includes a road paver with a screed without a tamping device and with a screed and a tamping device. If the screed includes a tamping device, the tamping device can also include a heating device, although variants of the present invention are also included, according to which the tamping device does not have a heating device. An exemplary calculation of the width of the screed is achieved by measuring the electric current to the heating device of the screed directly or indirectly. As the voltage applied and the electrical heating power of the built-in heating device are known, the screed width can be deduced from the measured current intensity. The measurement can take place in a single-phase or a multi-phase system (three-phase network), in which case the neutral current can also be included in the measurement. The screed width determined by current measurement can be combined with a screed width determined by distance measurement (for example, in the case of paving screed segments that can be moved in and out of the screed).

Generic paving screeds frequently include an electrical heating device with which the paving screed can be heated in order, e.g., to prevent sticking of the material to be paved to the screed. Such heating devices can be, e.g., electric heating elements arranged on the side of the paving screed opposite the paver side. Such a heating device is described, for example, in DE 10 2004 003 356 A1. There are paving screeds with and without a tamping device. Furthermore, the tamping device, even if present, does not always have to be heated for each screed. The present invention can be applied to all types of screeds, whether with or without a tamping device and regardless of whether or not it can be heated. The main thing is that a heating device is provided at all on the screed.

One aspect of the present invention is to determine the configuration of the road paver indirectly, in particular with respect to the number, position and type of width extension elements, by measuring an electrical operating parameter of the electric heating device on the screed or the tamping device so that a comparatively accurate calculation of the width, the weight and/or the center of gravity of the paving screed is possible. On the basis of the width, the mass and/or the center of gravity (the center of gravity of the screed) calculated in this manner, the control of the road paver can then be carried out in a particularly exact fashion. For example, the drive can be controlled in such a way that the road paver drives at the optimum speed for the screed used. The material flow of the material to be paved can also be adapted to the quantity required by the screed. The values determined can also be used to ascertain exactly how much electrical energy must be provided by one or more generators for supplying the heating device of the screed, which protects the generators from unnecessary strain and enables efficient generator control. One embodiment of the present invention therefore provides that the control unit is configured to adjust an operating parameter of the drive control and/or of the material flow control and/or of the heating control as a function of the determined weight and/or of the determined center of gravity and/or of the determined width of the screed transversely to the working direction of the screed. For example, the control unit can be configured to control a material conveying device and/or a transverse conveying device of the road paver on the basis of the determined width and the specified paving depth. In this case, the material conveying device is the conveying device that transports the material to be paved from the material bunker through the paver in the direction of the screed, while the transverse conveying device distributes the material to be paved transversely to the working direction over the entire width of the screed. Moreover, the paving volume can be calculated from the width of the screed if the paving depth is known, which provides logistical and economic advantages. According to a further embodiment of the present invention, it is therefore provided that the control unit is configured to determine the paving volume considering the known paving height and the determined width of the screed transversely to the direction of operation of the screed. The present invention enables an exact control of all of these operating parameters of the road paver.

In particular, the load pressure and/or relief pressure required for an operating state of the road paver, which can/must be applied to the screed by hydraulic actuating cylinders, can be calculated precisely and the hydraulic cylinders can thus be controlled and/or adjusted correctly in order to keep the screed in a position corresponding to its operating state. The "load pressure" is understood here to be the pressure that leads to the lowering of the screed and acts in the direction of the force of the weight of the screed. Correspondingly, "relief pressure" is understood to mean the pressure that leads to the lifting of the screed and counteracts the force of the weight of the screed. A hydraulic control arrangement can be provided for controlling at least two actuation cylinders, in particular double-acting actuation cylinders, which are spaced apart from one another transversely to the operating direction and are connected on one side to a frame of a road paver and on the other to a screed of the road paver, wherein the screed can be subjected to a load pressure and/or a relief pressure by means of the actuating cylinder, while the desired load and/or relief pressure can be determined indirectly via at least one measurable operating parameter of an electric heating device on the screed and/or on a tamping device. The hydraulic control arrangement can comprise, e.g., a control unit or can be functionally connected with such a control unit. The control of the actuating cylinders can occur manually, e.g., by displaying the necessary "desired" load pressure and relief pressure determined by the hydraulic control arrangement or the control unit by means of a suitable display device, or also automatically, especially by means of a suitable control system. Hydraulic control arrangements comprising actuating elements that can be actuated manually and with which an actual adjustment of the actuating cylinders can occur are also comprised by the present invention. By means of the hydraulic control arrangement or the control unit, the necessary cylinder forces for moving the screed can be determined very simply in an indirect manner. The larger or wider an add-on part for the screed is, the greater the heating area and thus consumption of electrical heating energy. By measuring an electrical operating parameter of the electrical heating device for the screed, e.g., by measuring the heating power received or the resistance of the heating device, the type or width and the number of the add-on parts can be determined easily and automatically without the intervention of an operator of the road paver. The mass of the screed and the center of gravity of the screed transversely to the direction of travel can then be calculated on this basis and, while optionally considering further variables such as the hydraulic extension width, the speed, the transverse and longitudinal inclination of the road paver, the further parameters, such as the necessary force or the load pressure or relief pressure to be exerted on the hydraulic cylinders, can be calculated easily and accurately. A clear improvement in the adjustment behavior of the road paver and, in particular, of the hydraulic cylinders may be achieved by these means. The solution according to one embodiment of the present invention also constitutes a cost-efficient improvement: no additional costs are incurred, as no technical modifications are necessary with respect to the add-on parts, since measuring signals already present on the road paver can be used for the calculations to be carried out. The "desired load pressure and/or relief pressure" in question is based on the current paving situation and may vary. Ultimately, the "desired load pressure and/or relief pressure" constitutes a target value for a desired surface pressure of the screed. It is essential that the "desired load pressure and/or relief pressure" corresponds to the pressure conditions in the actuation cylinders that must be present in order to place a desired force on the screed. Depending on the paving situation and the composition of the mixed material, the surface pressure defined by the weight of the screed is either too high or too low. A low surface pressure impedes, e.g., sufficient compaction of the mixed material by the screed. A high surface pressure increases the traction of the paver necessary for towing the screed.

The measurement of the measurable electrical operating parameter occurs separately on the right and the left side (with respect to the paving direction of the road paver), in particular in order to determine also the mass distribution of the screed. In this case, it is possible, for example, to determine the hydraulic extension state of the adjustable screeds on the base screed and/or to determine the number of attached screeds on both sides. The center of gravity of the total screed unit can then be determined on this basis and the actuating forces or the load and/or relief pressures on the two hydraulic cylinders can be set accordingly.

The hydraulic control arrangement expediently comprises a control unit, which is supplied on the input side with the corresponding information about the at least one electrical operating parameter, e.g., picked up via a suitable sensor such as, e.g., a sensor for determining a resistance, heating power, etc. The control unit is configured in such a manner that it determines the center of gravity of the screed on the basis of the determined measurable electrical operating parameter of the electric heating device and/or, for example, generates a control signal for the actuating cylinders or a display device based on this information.

According to an embodiment of the present invention, the at least one electrical operating parameter is a heating resistance of the screed and/or of the tamping device or the heating power received by the screed and/or the tamping device or the power consumption on the screed and/or the tamping device. By measuring the heating resistance or the heating power or power consumption, e.g., by means of a suitable sensor, a simple determination of the width, the mass or the center of gravity is possible, as already described above, so that a precise control of the operating parameters and hydraulic cylinders becomes possible.

Road pavers are frequently used in different environmental conditions, for example, depending on the environmental topography. Particularly, good paving results may be obtained when the load pressure and/or the relief pressure can be set by the control unit as a function of a defined operating state of the road paver, the defined operating state being, in particular, a downtime of the road finisher, an ascent of the road paver or an inclined position of the road paver. The defined operating state further includes different states of the road paver depending on the speed of travel, as well as starting and stopping operations. It is therefore ideal if the hydraulic control arrangement and/or the control unit displays or applies or initiates a relief pressure to the at least one actuating cylinder in the defined operating state of the downtime, ascent or inclined position, by signaling to a display device or on its own in order to avoid that the screed or tamping device sinks into the substrate to be treated and/or to improve the traction of the road paver. For example, if the movement of the road paver is interrupted, provisions are made in an embodiment of the present invention that the hydraulic control arrangement and/or the control unit automatically regulates the relief pressure upwards in the sense of an automatic function in order to prevent the paving screed from sinking into the material to be paved. As the weight and the weight distribution of the paving screed are known to the hydraulic control arrangement and/or the control unit, this can be achieved in a very exact manner. In the case of an "ascent", the hydraulic control arrangement and/or the control unit also regulate the relief pressure upwards in order to improve the traction of the road paver in this way. In the case of a "paving start", however, the hydraulic control arrangement and/or the control unit automatically increases the load pressure in order to prevent the floating of the paving screed on the material to be paved or at least generates a display signal for a display device via which the required increase in load pressure is indicated. In principle, therefore, the present invention includes embodiments according to which the hydraulic control arrangement and, in particular, the control unit is configured in such a way that it independently assumes the control of the load pressure and relief pressure on the actuating cylinders without the need for separate manual intervention by the operator. Alternatively, however, the present invention also extends to those embodiments in accordance with which the hydraulic control arrangement and, in particular, the control unit is configured in such a way that it merely indicates whether or not and how the load pressure and/or relief pressure on the actuation cylinders must be modified in order to attain the desired operating position of the screed or the desired load pressure and/or relief pressure. The actual change in existing load pressures and/or relief pressures towards the desired values or values determined by the hydraulic control arrangement and/or the control unit is then effected, for example, by a manual adjustment, wherein a constant comparison between actual values and the target values specified by the hydraulic control arrangement and/or the control unit occurs here.

The screed and/or the tamping device has/have a variable size, which can be varied, in particular, by providing at least one add-on part. Here, size designates, in particular, the paving width, i.e., the horizontal extension of the paving screed transversely to the paving direction. Depending on the type of the screed, the paving width can, for example, be broadened by so-called add-on screeds, which are optionally added to a basic screed. In addition, or alternatively, a screed that is laterally displaced in relation to the basic screed can also be provided.

Furthermore, it is advantageous if a measuring device for measuring the heating power on the screed and/or the tamping device, for measuring a resistance on the screed and/or the tamping device and/or for measuring the power consumption on the screed and/or on the tamping device is provided. Such a measuring device may, for example, be a voltmeter, an amp meter, etc.

Furthermore, a device for determining a cylinder force of the at least one actuating cylinder may be provided, which indirectly determines the relief pressure required in the defined operating state of the road paver by calculating the mass of the screed and the center of gravity of the screed transverse to a direction of travel of the road paver. For this purpose, a position sensor can be used to determine the extension position, which, in conjunction with the aforementioned measuring device for determining the heating power, permits an inference regarding the lateral center of gravity and the weight of the screed.

The device for determining the cylinder force can determine the mass and the center of gravity of the screed on the basis of the heating power measured or the resistance measured or the power consumption measured. These steps can be carried out centrally in a common control unit.

According to a further aspect of the present invention, the device for determining the cylinder force further receives at least one signal corresponding to a hydraulic extension width of the screed, to a speed of the road paver and/or to a transverse and longitudinal inclination of the road paver in order to calculate the cylinder force required to provide the necessary load pressure and/or relief pressure in the defined operating state of the road paver. In particular, this can be a position sensor, particularly, e.g., on or within an adjusting cylinder by means of which the working width adjustment of the screed can be modified.

The hydraulic control arrangement can control a first actuating cylinder and a second actuating cylinder of the screed in order to adjust the required load pressure and/or relief pressure. The hydraulic control arrangement then automatically regulates the setting of the pressure conditions in the first and the second actuating cylinders.

Alternatively, a display device can also be provided, which is controlled by the control arrangement and/or the control unit. A concrete value corresponding to the desired load pressure and/or relief pressure for the actuating cylinder, for example, in the form of a numerical display, can be displayed via the display device. In addition, or alternatively, the display can also occur via signal lights only, e.g., via a traffic light and/or bar display, which, in particular, signals when the desired load pressure and/or relief pressure determined by the control arrangement is reached. The display is configured in such a way that it assumes its own display state for the respective states "desired load pressure and/or relief pressure has been reached", "the actual load pressure and/or relief pressure must be increased to the desired load pressure and/or relief pressure" and "the actual load pressure and/or relief pressure must be reduced to the desired load pressure and/or relief pressure". Ideally, the display device is arranged on the operating platform of the road paver and/or on the screed.

A further aspect of the present invention lies in a method for determining a width and/or a weight and/or a center of gravity of a screed of a road paver, in particular a road paver in accordance with the foregoing descriptions, comprising the following steps: measuring an electrical operating variable of a heating device, such as, in particular, a heating device of the type screed and/or tamper heater, in particular the electrical operating variable of a heating power, a heating resistance or a power consumption of the heating device; and calculating the weight and/or the center of gravity and/or the width of the screed transversely to the operating direction of the screed via the electrical operating variable. As already described in the foregoing regarding the road paver, the method in accordance with the present invention enables a precise control of a whole series of operating parameters of the road paver by means of the calculated weight and/or the center of gravity and/or the width of the screed. The method can, for example, include adapting an operating parameter of the drive control and/or the material flow control and/or the heating control. Likewise, the method may include the determination of the paving volume considering the known paving height.

Optionally, the method may include: the control of a relief pressure and/or a load pressure of at least two, in particular double-acting, actuating cylinders, spaced apart from one another transversely with respect to the direction of operation and each connected on one side with a frame of a road paver and on the other side with a screed of the road paver, wherein the screed can be subjected to a load pressure or a relief pressure by means of the actuating cylinder; and, furthermore, the determination of a target value for a ("desired") load pressure and/or relief pressure necessary for a defined operating state of the road finisher and corresponding to the calculated weight and/or the center of gravity of the screed. It may be provided that the electrical operating variable is measured only after the heating device for the heating of the screed and/or tamping device has been switched on. The method in accordance with the present invention enables an accurate, automatic calculation of the correct or required load pressure or relief pressure to be applied to the hydraulic cylinders in order to obtain a desired positioning of the screed, in particular with regard to the adjustment of its longitudinal axis relative to the horizontal plane, and provides the advantages already described in connection with the road paver in accordance with the present invention. The method further includes a step of detecting an actual value of the load pressure and/or the relief pressure.

The method may further include a step of controlling the at least one actuating cylinder for generating the load pressure and/or the relief pressure required for the defined operating state, wherein the defined operating state is, in particular, a downtime of the road paver, an ascent of the road paver or an inclined position of the road paver. Furthermore, the operator can additionally, or alternatively, influence the determined load pressure or relief pressure manually in order to take into account influential variables that have not been captured, such as the composition of the material mix and actual temperature of the material mix.

The method may additionally, or alternatively, further include a display of the target value or at least a display of the circumstance that the target value has not yet been attained. The display occurs in such a way that the operator can recognize by means of the display whether he must increase or decrease the current load pressure and/or relief pressure in order to approach the target value of the load pressure and/or relief pressure, in particular the target value determined by the hydraulic control arrangement.

The inventive method is carried out by the control unit and/or the hydraulic control arrangement. The latter is/are configured in a corresponding manner for carrying out the method.

BRIEF DESCRIPTION OF THE DRAWINGS

In the following, the present invention is described in greater detail by means of the Figures, which are schematic in nature.

DETAILED DESCRIPTION OF THE INVENTION

Figure 1:
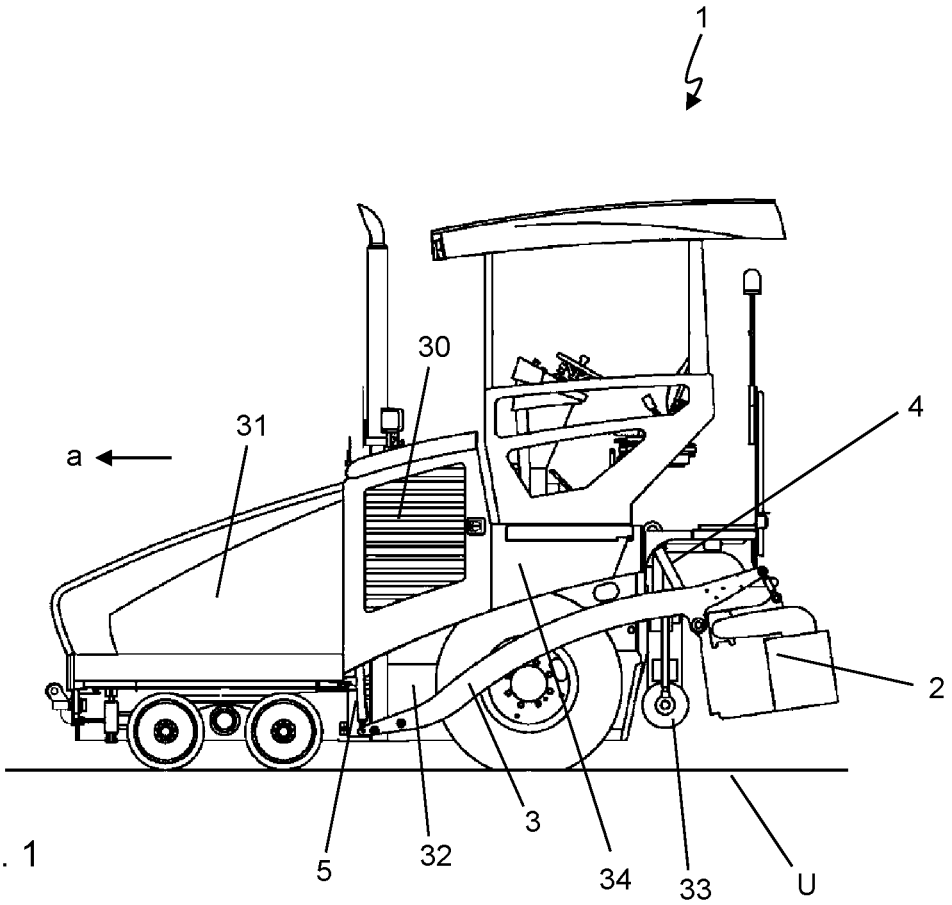
FIG. 1 shows a side view of a road paver with a screed.

FIG. 1 shows a side view of a road paver 1 with a machine frame 34 (also referred to as frame 34), a material bunker 31 (also referred to as bunker 31), a drive 30, which is usually a diesel combustion engine, a material conveying device 32, which transports material from the bunker 31 through the road paver 1 against the working direction "a" towards the rear and a transverse conveying device 33, for example, a cross-feed screw, which distributes the material to be paved over the entire paving width. In addition, the road paver 1 includes a screed 2, which is attached to a tractor part of the road paver 1 via holding arms 3. The screed 2 is mounted in a height-adjustable manner on the road paver 1 and can be raised, lowered or held in any desired position by means of two double-acting hydraulic cylinders 4, only one of which is visible here. The holding arms 3 are height-adjustable via a leveling cylinder 5 in order to set the angle of incidence of the screed 2. The hydraulic cylinders 4 are connected in an articulated manner to the frame of the road paver 1 on the piston side, i.e., to the cylinder housing. On the piston rod side, the hydraulic cylinders 4 are connected in an articulated manner to the screed 2. On account of its own weight, the screed 2 generates the weight force $F_B$ (FIG. 3), which is directed vertically downwards. In the position shown, the screed 2 is lifted in accordance with the defined operating state, here during a downtime of the road paver 1, so that the screed 2 does not exert any force on the ground and the screed 2 is prevented from sinking into the ground. In this operating state, a corresponding relief pressure is exerted on the hydraulic cylinders 4. If, on the other hand, the ground is processed, i.e., the road paver 1 is in operation and deposits a layer of bituminous paving material of the desired layer thickness on the ground U, the screed 2 is lowered so that it applies a force on the ground. For this purpose, the relief pressure in the hydraulic cylinders 4 is lowered correspondingly. Moreover, it is also possible to apply a load pressure via the hydraulic cylinders 4. In this case, therefore, forces greater than the pure weight force of the paving screed are exerted on the ground to be paved by way of the screed.

Figure 2:
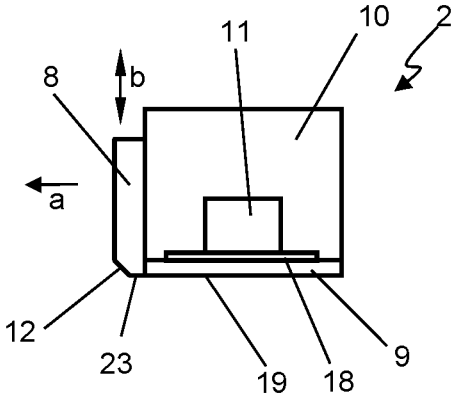
FIG. 2 shows a side view of a screed of a road paver, the screed comprising a heating device.

FIG. 2 shows a side view of a screed 2 with a tamping strip or tamping device 8 and a smoothing plate 9 arranged behind it in the working direction a, as well as a supporting housing 10 with an excitation device 11. The tamping device 8 is adjustable vertically in the direction of the arrow "b" and thus performs a tamping movement in the direction of the arrow "b" during the paving operation. In its front region, the tamping device 8 has a guide surface (entry slope 12) extending obliquely in the working direction "a", followed by a tamping surface 23 extending horizontally. The smoothing plate 9 is connected to the tamping strip. Above the smoothing plate 9, an excitation device 11 is arranged, via which a vibratory movement can be induced in the screed 2. The smoothing plate 9 has an underside 19, which slides over the material to be paved during operation and smoothes it. The smoothing plate 9 and the region with the inlet slope 12 are provided with heating devices 18, which can be configured, e.g., as heating layers (a first heating layer, an insulation layer and a metallic heating layer), which are applied, e.g., by thermal spraying, in particular by plasma spraying or HVOF, successively to the smoothing plate 9 and/or tamping device 8. However, other embodiments of electrical heating devices for heating the screed 2 and/or tamping device 8 can also be implemented, such as, e.g., heating rods. It is also possible to configure the tamping device 8 entirely without a heating device or the screed 2 without a tamping device.

In accordance with the present invention, the width, the weight and/or the center of gravity of the paving screed 2 can be determined by measuring an electrical operating parameter of the electrical heating device. This shall be described further in the following figures.

Figure 3:
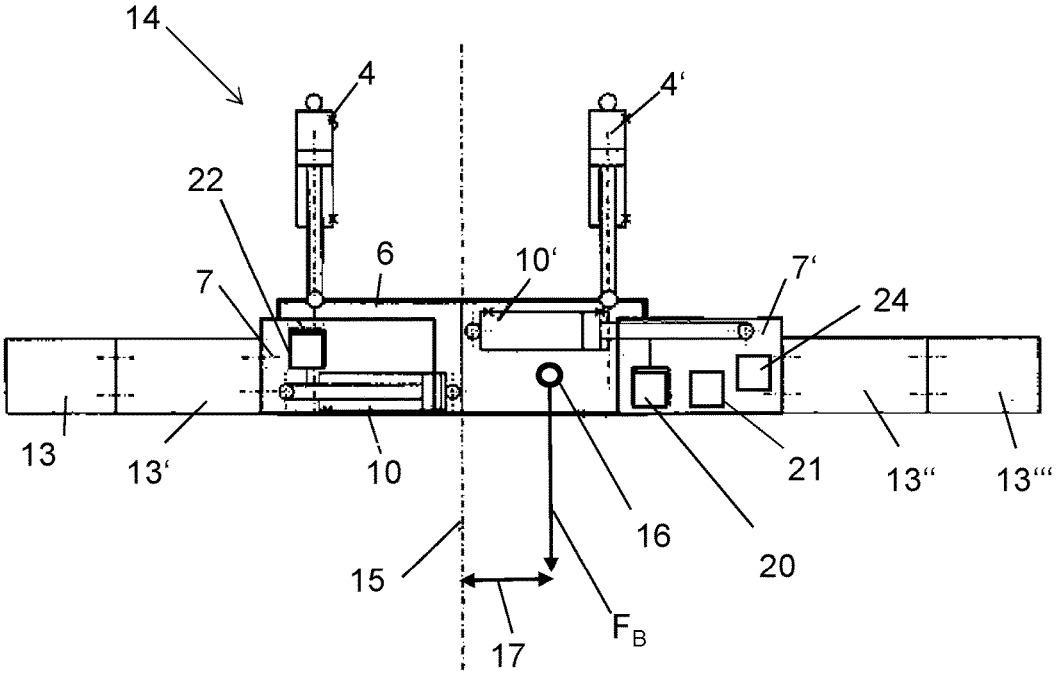
FIG. 3 shows a schematic view of a screed of a road paver.

FIG. 3 shows a schematic view of the screed 2, here with an uneven weight distribution. The screed 2 includes a basic or main screed 6 and two screed extensions 7, 7', which can be extended individually and hydraulically via positioning cylinders 10, 10'. In addition, additional screeds, configured as rigid add-on parts 13, 13', 13", 13'", can be attached to the screed extensions 7, 7' for broadening the working width, if required. The actuating cylinders, which are configured as double-acting hydraulic cylinders 4, 4', are each connected in an articulated manner to one side of the basic screed 6, each at an equal distance from the axis of symmetry 15. If the screed 2 is widened symmetrically, the overall center of gravity of the screed 2 lies on the line of symmetry 15. In this case, the cylinders 4, 4' would be supplied with the same load pressure and relief pressure. However, there are paving situations in which an asymmetrical broadening of the screed 2 is required, as shown FIG. 3. In this case, the overall center of gravity 16 of the screed 2 shifts to the right by a length 17 so that the line of action of the weight force FB of the screed 2 is shifted by the length 17 from the axis of symmetry 15.

The hydraulic cylinders 4, 4' are actuated independently of one another in the case of a non-uniform distribution of weight due to an asymmetrical screed broadening so that overall a uniform, even distribution and compression of the material is achieved. For example, the right cylinder 4' could raise the right side of the base screed 6 slightly in order to counteract a slope due to the displacement of the center of gravity 16. However, it is also conceivable to press the left side of the basic screed 6 on the material to be laid by means of the left cylinder 4 or to carry out both measures simultaneously. However, in order to determine the pressure to be applied on the left and right cylinders 4, 4', i.e., the load pressure or the relief pressure, it is necessary to determine both the mass of the screed 2 and the exact position or displacement of the overall center of gravity 16. According to one embodiment of the present invention, this occurs via the hydraulic control arrangement 14 and/or the control unit 20, which determines the desired load pressure and/or the relief pressure to be applied on the hydraulic cylinders 4, 4' indirectly via at least one electric operating parameter of an electric heating device 18 (see FIG. 2), which can be measured on the screed 2 and/or on a tamping device 8. In particular, the at least one electrical operating parameter is a heating resistance of the screed 2 and/or of the tamping device 8 or the heating power received by the screed 2 and/or the tamping device 8 or the power consumption on the screed 2 and/or the tamping device 8. The load pressure and/or the relief pressure can be set by the control unit 20 as a function of a defined operating state of the road paver 1. The defined operating state in which a relief pressure is applied to the hydraulic cylinders 4, 4' comprises a downtime of the road paver, an ascent or an inclined position. In this case, the hydraulic cylinders 4, 4' are subjected, as required, either to the same relief pressure or to two different relief pressures, for example, in the case of an inclined position and/or an asymmetrical distribution of the mass of the screed 2 with the add-on parts 13, 13', 13", 13'".

In order to determine the heating power, the resistance at the screed 2 and/or at the tamping device 8 (see FIG. 2), and/or the power consumption at the screed 2 and/or at the tamping device 8, different measuring devices are provided, which are designated here schematically by the reference numeral 21. Likewise, a device 22 is provided for determining the cylinder force of the hydraulic cylinders 4, 4', which device 22 indirectly determines the relief pressure required in the defined operating state of the road paver 1 by calculating the mass of the screed 2 and the overall center of gravity 16 of the screed 2 from the above-described electrical operating parameters.

Figure 4A:
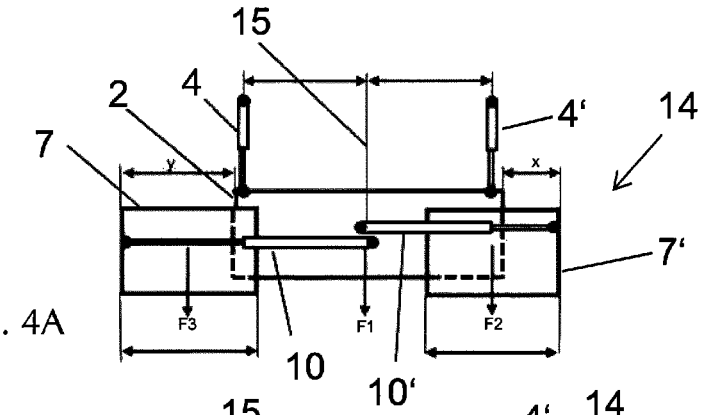
FIGS. 4A-4D show schematic views of different screed configurations.
Figure 4B:
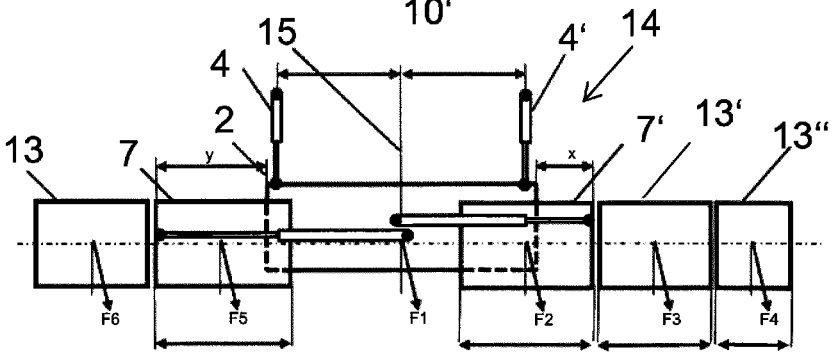
Figure 4C:
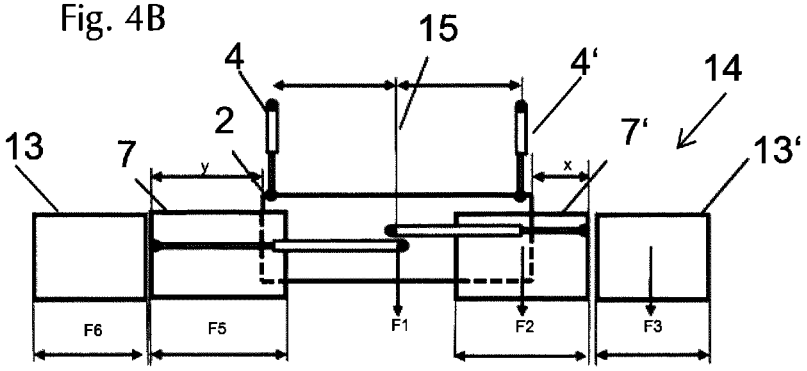
Figure 4D:
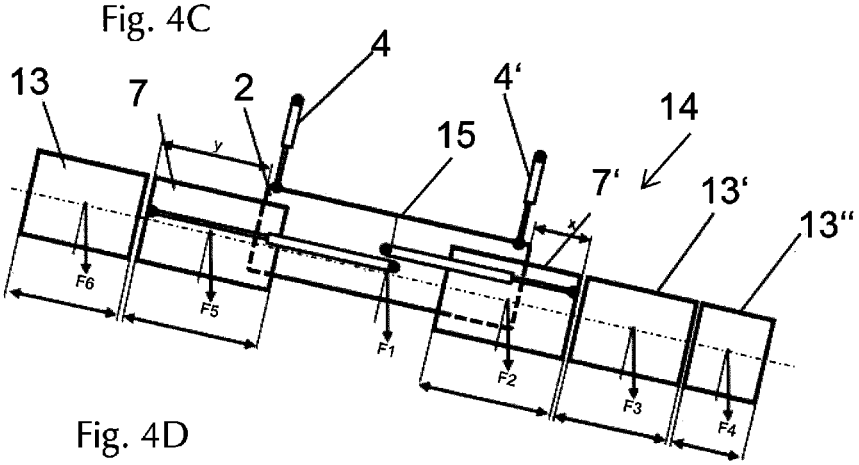

FIGS. 4A-4D show various configurations of the screed 2, specifically different attachment sizes and mass distributions of the screed 2 transversely to the direction of travel or working direction "a". The force vector F1 acts on the basic screed 6 and the force vectors F2, F3, F4, F5 and F6 act on the respective centers of gravity of the attachments. As can be seen in FIG. 4A, a situation is shown here in which the left width extension 7 of the screed 2 is extended further than the right width extension 7' (y>x), which causes a displacement of the overall center of gravity of the screed 2. The situation shown in FIG. 4B basically proceeds from the situation shown in FIG. 4A, but add-on parts 13, 13', 13" are additionally provided on the screed 2, namely a single add-on part 13 on the left side of the screed 2 and two further add-on parts 13', 13" on the right side of the screed 2, which leads to a further displacement of the center of gravity. FIG. 4C shows a situation, which starts out again from the situation shown in FIG. 4A, but in contrast to FIG. 4C, the add-on parts 13, 13' of equal size are provided on either side of the axis of symmetry 15 of the screed 2. In this case as well, the center of gravity is shifted due to the different extension widths of the right and left screed width extensions 7, 7'. Finally, FIG. 4D shows a situation in which the arrangement shown in FIG. 4B is guided in an inclined position. The uniform load pressure or relief pressure of the screed is achieved by adjusting the respective forces on the right and left hydraulic cylinders 4, 4'. The adjustment of these forces is effected by applying appropriate pressure to the actuation cylinders. For all the situations illustrated, it is therefore necessary to determine the mass of the screed, i.e., including all width extensions 7, 7' and add-on parts 13, 13', 13" and, in particular, in view of the asymmetric mass distributions, also the distances of the add-on parts with respect to the axis of symmetry 15, in order to determine indirectly the forces F1-F6 acting downwards and the required load pressure or relief pressure to be applied to the hydraulic cylinders 4, 4', as already described above.

The determination in accordance with one embodiment of the present invention begins here. With the enlargement of the paving width, the heating surface of the overall screed also increases, as does the consumption of electrical heating energy. If an electrical operating parameter proportional to the electrical heating energy is now determined, the total width of the screed 2 can be inferred. If, for example, the mass of the add-on parts 13, 13' and 13" is known, the heating power of the overall arrangement, e.g., as a function of the number of add-on elements 13, 13' and 13", and ultimately the total weight of the screed arrangement can be determined. For ascertaining the center of gravity, it is useful if the electrical operating parameter in question, e.g., the heating power, is determined separately at the sides of the basic screed in order to be able to draw conclusions here about a weight distribution at the sides. Further data advantageously taken into account by the control unit 20 are parameters such as the hydraulic extension width of the add-on screeds 7, 7', the speed and/or the transverse and/or longitudinal inclination of the road paver 1, etc. It is then possible to determine the required adjusting force, whether for a load pressure or a relief pressure, on the right and left actuating cylinders 4, 4'.

Overall, an automatic calculation of the required pressure for the actuating cylinders 4, 4' is thus possible with the system described above, as is an automatic adaptation of the entire system to different extension situations and/or overall configurations of the screed 2. In addition, or alternatively, a display of the required pressure—or at least of whether the required pressure has already been reached, has yet to be reached or has been exceeded—can also be provided. For this purpose, a display device 24, e.g., a display screen, is provided on the screed 2 itself and/or in the operating platform of the road paver 1, the display device 24 also being controlled by the control unit 20. As an alternative to the automatic adaptation of the entire system, the adjustment of the actuation cylinders 4, 4' can also occur by means of manual entries until the target values determined by control unit 20 have been reached.

Figure 5:
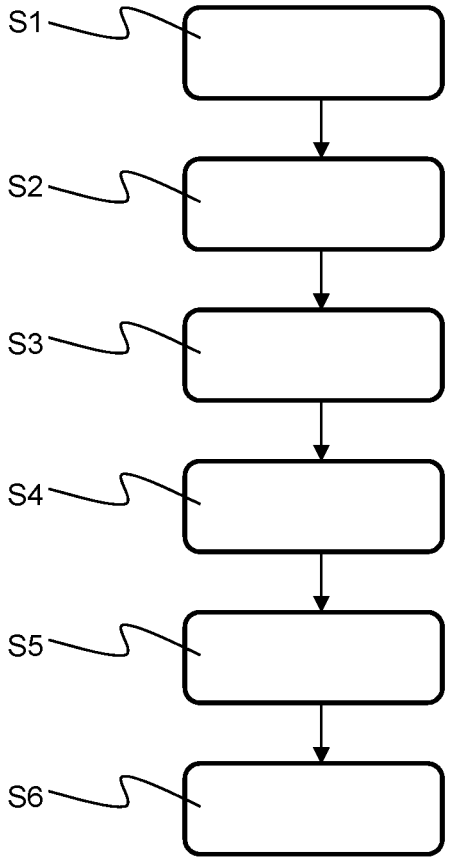
FIG. 5 shows a flow diagram for the schematic representation of the sequence of the method in accordance with the present invention.

FIG. 5 shows a flow diagram for the schematic representation of the sequence of the method in accordance with one embodiment of the present invention. It includes the following steps. In a first step S1 of the present example, a heating device 18 for heating the screed 2 and/or the tamping device 8 is switched on, although this step is optional. An electrical operating variable of the heating device 18, in particular a heating power, a heating resistance or a power consumption of the heating device 18, is then measured in a next step S2. In step S3, the width, the weight and/or the center of gravity transversely to the working direction "a" of the screed 2 is calculated via the electrical operating variable. The calculated values can be used to control a plurality of operating parameters of the road paver 1. In step S5, for example, a target value for a load pressure and/or relief pressure necessary in a defined operating state of the road paver 1 and corresponding to the calculated weight and/or the center of gravity of the screed 2, can be determined. Furthermore, the method includes a step S6 for detecting an actual value of the load pressure and/or the relief pressure.

While the present invention has been illustrated by description of various embodiments and while those embodiments have been described in considerable detail, it is not the intention of Applicants to restrict or in any way limit the scope of the appended claims to such details. Additional advantages and modifications will readily appear to those skilled in the art. The present invention in its broader aspects is therefore not limited to the specific details and illustrative examples shown and described. Accordingly, departures may be made from such details without departing from the spirit or scope of Applicant's invention.

What is claimed is:

1. A road paver comprising:

a drive;

a bunker;

a material conveying device;

a screed and/or a tamping device;

an electric heating device on the screed and/or the tamping device;

a control unit; and a measuring device configured for measuring a heating power on the screed and/or on the tamping device and/or for measuring a resistance on the screed and/or on the tamping device and/or for measuring a power consumption on the screed and/or on the tamping device, wherein the control unit is provided which is configured to determine a weight and/or a center of gravity and/or a width of the screed, with the center of gravity and/or a width of the screed being determined transversely to a working direction of the screed, in response to a measurable electrical operating parameter of the electric heating device on the screed and/or on the tamping device as measured by the measuring device.

2. The road paver according to claim 1, wherein the at least one electrical operating parameter is a heating resistance of the screed and/or of the tamping device or a heating power received by the screed and/or the tamping device or a power consumption on the screed and/or the tamping device.

3. The road paver according to claim 1, wherein the screed and/or the stamping device has a variable size, which can be varied in particular by providing at least one add-on part.

4. The road paver according to claim 1, wherein the control unit is configured for adapting an operating parameter of a drive control and/or of a material flow control and/or of a heating control as a function of the determined weight and/or of the determined center of gravity and/or the determined width of the screed transversely to the working direction of the screed.

5. The road paver according to claim 1, wherein the control unit is configured for determining a paving volume considering a known paving height and the determined width of the screed transversely to the direction of operation of the screed.

6. The road paver according to claim 1, wherein a hydraulic control arrangement is provided for controlling at least two actuating cylinders which are spaced apart from one another transversely with respect to the working direction, wherein the actuation cylinders are each connected at least indirectly on one side with a frame of the road paver and on the other side with the screed of the road paver, wherein the screed can be subjected to a load pressure and/or a relief pressure via the actuating cylinders, and wherein the control unit is configured to determine a desired load pressure and/or a relief pressure from the determined weight and/or center of gravity and/or width of the screed transversely to the direction of operation of the screed.

7. The road paver according to claim 6, wherein the load pressure and/or the relief pressure can be adjusted by the control unit as a function of a defined operating state of the road paver, wherein the defined operating state includes a downtime of the road paver, an ascent of the road paver or an inclined position of the road paver.

8. The road paver according to claim 7, wherein the control arrangement applies a relief pressure to the at least two actuation cylinders in the defined operating state of a downtime, an ascent or an inclined position.

9. The road paver according to claim 7, wherein a device for determining a cylinder force of the at least two actuation cylinders is provided, which indirectly determines the relief pressure required in the defined operating state of the road paver via of a calculation of the mass of the screed and the center of gravity of the screed transversely to a working direction of the road paver.

10. The road paver according to claim 9, wherein the device for determining the cylinder force determines the mass and the center of gravity of the screed on the basis of a measured heating power or a measured resistance or a measured power consumption.

11. The road paver according to claim 9, wherein the device for determining the cylinder force further takes into account a hydraulic extension width of the screed, a speed of the road paver and/or a transverse and longitudinal inclination of the road paver to calculate the required cylinder force in order to provide the necessary relief pressure in the defined operating state of the road paver.

12. The road paver according to claim 6, wherein the control arrangement controls a first actuating cylinder and a second actuating cylinder of the screed in order to provide the required relief pressure.

13. A method for determining a width and/or a weight and/or a center of gravity of a screed of a road paver according to claim 1, comprising the steps:

measuring an electric operating variable of a heating device; and calculating the weight and/or the center of gravity and/or the width of the screed transversely to the operating direction of the screed from the electric operating variable.

14. The method according to claim 13, wherein the method further comprises the step of controlling a relief pressure and/or a load pressure of the at least two actuating cylinders which are spaced apart from one another transversely to the working direction and are each connected on one side to a frame of the road paver and on the other side to a screed of the road paver, wherein the screed can be subjected to a load pressure or a relief pressure via the actuating cylinders and a target value for a load pressure and/or a relief pressure necessary in a defined operating state of the road paver and corresponding to the calculated weight and/or the center of gravity position of the screed is determined.

15. The method according to claim 13, wherein the method further comprises a step of detecting an actual value of a load pressure and/or a relief pressure.

16. The method according to claim 13, wherein the method further comprises the step of controlling the at least two actuation cylinders for generating a load pressure and/or a relief pressure required for a defined operating state, and wherein the defined operating state comprises a downtime of the road paver, an ascent of the road paver or an inclined position of the road paver.

17. The method according to claim 13, wherein the method comprises the adaptation of an operating parameter of a drive control and/or a material flow control and/or a heating control.

18. The method according to claim 13, wherein the method comprises the determination of a paving volume considering a known paving height.

19. The method according to claim 13, wherein the electric operating variable comprises a heating power, a heating resistance or a power consumption of the heating device.

* * * * *